US008944771B2

(12) United States Patent
Lischer et al.

(10) Patent No.: US 8,944,771 B2
(45) Date of Patent: Feb. 3, 2015

(54) REDUCTION OF TURBOCHARGER CORE UNBALANCE WITH CENTERING DEVICE

(75) Inventors: Thomas Lischer, Neustadt (DE); Denny King, Canton, NC (US)

(73) Assignee: BorgWarner Inc., Auburn Hills, MI (US)

( * ) Notice: Subject to any disclaimer, the term of this patent is extended or adjusted under 35 U.S.C. 154(b) by 718 days.

(21) Appl. No.: 13/256,745

(22) PCT Filed: Mar. 19, 2010

(86) PCT No.: PCT/US2010/027925

§ 371 (c)(1),
(2), (4) Date: Sep. 15, 2011

(87) PCT Pub. No.: WO2010/111131

PCT Pub. Date: Sep. 30, 2010

(65) Prior Publication Data

US 2012/0003093 A1 Jan. 5, 2012

Related U.S. Application Data

(60) Provisional application No. 61/163,177, filed on Mar. 25, 2009.

(51) Int. Cl.
*F04D 29/34* (2006.01)
*F01D 5/02* (2006.01)

(52) U.S. Cl.
CPC ..... *F01D 5/027* (2013.01); *F05D 2230/64* (2013.01); *F05D 2250/232* (2013.01); *F05D 2250/241* (2013.01); *F05D 2220/40* (2013.01)
USPC ..... 416/204 R; 416/244 R

(58) Field of Classification Search
USPC ..... 416/244 R, 204 R, 245 R, 246
See application file for complete search history.

(56) References Cited

U.S. PATENT DOCUMENTS

| | | | | |
|---|---|---|---|---|
| 3,467,419 | A * | 9/1969 | Anderson et al. | 403/380 |
| 3,601,501 | A * | 8/1971 | Johnson et al. | 416/244 R |
| 4,694,689 | A | 9/1987 | Kawasaki | |
| 4,872,817 | A | 10/1989 | Kruif | |
| 5,174,733 | A | 12/1992 | Yoshikawa et al. | |
| 5,210,945 | A | 5/1993 | Suzuki | |
| 5,503,521 | A * | 4/1996 | Capon | 415/121.1 |
| 6,599,084 | B1 * | 7/2003 | Schutz et al. | 415/90 |
| 2004/0115071 | A1 | 6/2004 | Billington | |

FOREIGN PATENT DOCUMENTS

| | | | |
|---|---|---|---|
| CN | 2766040 | Y | 3/2006 |
| CN | 201106611 | | 8/2008 |
| EP | 1413765 | B1 | 3/2006 |
| RU | 2247871 | C1 * | 3/2005 |

* cited by examiner

*Primary Examiner* — Dwayne J White
(74) *Attorney, Agent, or Firm* — Miller Canfield

(57) ABSTRACT

Turbochargers operate at extremely high speed, so balance of the rotating core is of the utmost importance to turbocharger life. A special frusto-conical, or frusto-spherical, centering geometry is added to the interface of the compressor nut and the nose of the compressor wheel to aid in keeping the wheel, nut, and stub-shaft centered on the turbocharger axis to reduce the degree of core unbalance.

4 Claims, 12 Drawing Sheets

REDUCTION OF TURBOCHARGER CORE UNBALANCE WITH CENTERING DEVICE

FIELD OF THE INVENTION

This invention addresses the need for improved core balance throughput, and accomplishes this by designing a special centering geometry interface.

BACKGROUND OF THE INVENTION

Turbochargers are a type of forced induction system. They deliver air, at greater density than would be possible in the normally aspirated configuration, to the engine intake, allowing more fuel to be combusted, thus boosting the engine's horsepower without significantly increasing engine weight. This can enable the use of a smaller turbocharged engine, replacing a normally aspirated engine of a larger physical size, thus reducing the mass and aerodynamic frontal area of the vehicle.

Turbochargers (FIGS. 1 and 2) use the exhaust flow, which enters the turbine housing (2) from the engine exhaust manifold to drive a turbine wheel (51), which is located in the turbine housing. The turbine wheel is solidly affixed to the turbine end of a shaft, becoming the shaft and wheel assembly (50). A compressor wheel (20) is mounted the other end of the threaded shaft, referred to as the "stub shaft" (56), and the wheel is held in position by the clamp load from a compressor nut (30). The primary function of the turbine wheel is providing rotational power to drive the compressor.

The compressor stage consists of a wheel (20) and it's housing (10). Filtered air is drawn axially into the inlet of the compressor cover by the rotation of the compressor wheel (20). The power generated by the turbine stage to the shaft and wheel drives the compressor wheel to produce a combination of static pressure with some residual kinetic energy and heat. The pressurized gas exits the compressor cover through the compressor discharge and is delivered, usually via an intercooler, to the engine intake.

In one aspect of compressor stage performance, the efficiency of the compressor stage is influenced by the clearances between the compressor wheel contour (28) and the matching contour (13) in the compressor cover. The closer the compressor wheel contour is to the compressor cover contour, the higher the efficiency of the stage. In a typical compressor stage with a 76 mm compressor wheel, the tip clearance is in the regime of from 0.31 mm to 0.38 mm. The closer the wheel is to the cover, the higher the chance of a compressor wheel rub, so there has to exist a compromise between improving efficiency and improving durability.

The wheels in a compressor stage do not rotate about the geometric axis of the turbocharger, but rather describe orbits roughly about the geometric center as seen in FIG. 3. The "geometric center" (35) is the geometric axis of the turbocharger. The compressor end, with data taken from a cylindrical nut of the turbocharger, describes a series of orbits (81), which are grouped as larger orbits (83) for the purposes of evaluating the shaft motion of the rotor group.

The dynamic excursions taken by the shaft are attributed to a number of factors including: the unbalance of the rotating assembly, the excitation of the pedestal (i.e., the engine and exhaust manifold), and the low speed excitation from the vehicle's interface with the ground.

As a dynamic assembly, the rotating assembly passes through several critical speeds. At the first critical speed, the critical mode is rigid body bending. In this mode, the rotating assembly describes a cylinder. At the second critical speed, the critical mode is again that of a rigid body, but in the conical mode about the outer ends of the bearing span. At the third critical speed the critical mode is that of shaft bending. The third critical speed occurs at from 50% to 70% of the operational speed. The first two critical speeds are much lower than that and are passed through very quickly during accelerations.

The first two modes are predominantly controlled by the bearing stiffness. The third mode, that of shaft bending, is predominately controlled by the stiffness of the shaft. The stiffness of the shaft is proportional to $D_s^4$ where $D_s$ is the diameter of the shaft.

The power losses due to the bearing system are predominantly controlled by $D_s^3$. So it can be seen that the control of the third critical mode is a compromise between power losses, thus efficiency and shaft bending. When there is an unbalance force, acting on the rotating assembly at the compressor-end of the turbocharger, the stiffness of the shaft is a major factor in countering that force and also in allowing the turbocharger to continue to run after a compressor wheel rubs against its cover.

After a loss of oil pressure or oil flow to any of the journal or thrust bearings, the predominant ultimate cause of turbocharger failure is contact between a wheel and cover. This contact can be as mild as a rub of the rotating wheel on the cover, or an impact of the wheel on the cover. To minimize the risk of this contact, the manufacturer takes many steps to build dynamic integrity into the rotating components.

In a mid-sized, commercial Diesel turbo, for example, with a 76 mm compressor wheel, the shaft and wheel (50), seen in FIG. 2, which is recognized as the welded assembly of the turbine wheel (51) to the shaft, is balanced in two planes, the nose (89) and the backface (88). Since the shaft and wheel is finished as a very accurately machined, single component, with shaft diameters ground to tolerances in the tenth of a thousandth of an inch regime (2.54 microns), its inherent balance is quite good. In addition to these tightly held diametral tolerances, the diameters which support the journal bearings (70) on the large diameter end (52) of the shaft, and the stub shaft (56), upon which the compressor wheel and small parts are both axially and radially located, are held to a complex cylindricity tolerance measured in the regime of tenths of a micron.

The shaft and wheel component for the turbocharger size above is balanced within a range of 0.4 to 0.6 gm-mm. The next components in the rotating assembly are the thrust washer and flinger. Both components are ground steel and of relatively small diameter when compared to a wheel. The thrust collar has a mass of around 10.5 gm; the flinger has a mass of around 13.3 gm. Because they are totally circular and have a high degree of finish, these components have very close to perfect balance. The next component is the compressor wheel, which has a mass of around 199 gm.

The compressor wheel is an extremely difficult part to machine and balance. While it is ultimately balanced to a range of from 0.04 to 0.2 gm-mm in each plane, getting down to that limit is difficult. FIG. 4 shows a compressor wheel casting (15), FIG. 5 shows the same casting machined. The chucking lug (16) on top of the nose is used to locate the wheel for the first machining operation, which sets the machining of the backface (22); the lower mounting face (22); the OD (33) of the wheel; and the bore (27) in the center of the wheel. It is extremely critical to machine the bore (27) in the center of the wheel such that it is centered on the hub at both the nose end (21) and the hub end (22). This means that the majority of the mass of the machined wheel is centered on the bore (27) of the compressor wheel. The act of centering the as-yet un-machined casting on the imaginary turbocharger centerline (35)

also results in blades of equal length which further contributes to the balance of the component. If the wheel is not chucked exactly on center with the hub profile, the machining of the blade contour surfaces (28) off center (of the hub) results in blades of different lengths. Blades of unequal length can cause not only balance and blade frequency problems, but also once-per-revolution unwanted acoustic problems.

In the next chucking operation on the OD of the wheel (33) the top of the nose of the compressor wheel is machined flat so that this surface (21) is flat and parallel to the lower mounting surface (22), and perpendicular to the bore (27). Because the surface (21) on the nose of the compressor wheel is machined in a second chucking, it is difficult to develop the parallelism required with the lower mounting surface. This parallelism is critical from the aspect of maintaining the stub shaft cylindricity with the bearing journal zone (52). The reason it is critical is to ensure that, when clamp load is applied to this flat surface on top of the nose of the compressor wheel, the clamping forces are parallel to the shaft and wheel centerline, as defined by the cylindricity of the journal bearing surfaces (52) and the stub shaft mounting surfaces. This shaft and wheel centerline must then be parallel to, and coincident to, the turbocharger axis for the assembly to have acceptable core balance.

The compressor nut should not be referred to as a nut in the normal sense of the term. The function of the compressor nut is to apply sufficient clamp load to the compressor wheel such that it will not rotate under any dynamic conditions from max speed from cold start to hot shutdown at max speed.

While the nut is a relatively low mass item, at 6.3 gm in the turbo under discussion, its contribution to unbalance (as against balance) can be very large. A requirement of the nut is that the lower face, the face in contact with the face (21) on the nose of the compressor wheel, must be manufactured to a very tight perpendicularity tolerance to the bore of the thread in the compressor nut, in the range of 0.03 to 0.04 mm, so that when the nut is threaded onto the shaft and clamp load applied, the aforementioned lower face of the nut is applying a load close to normal to the face (21) on the nose of the compressor wheel. Failure to apply this load symmetrically, either normal to the face of the compressor wheel, or parallel to the shaft centerline (35), will cause bending of the shaft, with the result that the mass of the compressor wheel, nut, and stub shaft will be displaced from the turbocharger axis (35) causing a large unbalance in the rotating assembly. Since the nut is extremely difficult to assemble exactly on axis, the mass of the nut is a critical factor in the level of unbalance the bearing system can tolerate. For the same degree of unbalance in the core, the lower the mass of the nut, the higher the geometric run-out acceptable tolerance. Much effort goes into the design of the top end of the compressor wheel, the nut (30), and the amount of thread (57) visible above the nut to keep the mass in this zone to a minimum. If the nut is not perpendicular to the top of the compressor wheel, and parallel to the stub shaft below the nut, then the threaded part of the stub shaft, above the nut (i.e., with thread no longer engaged with the thread on the stub shaft), will also be off-center with the centerline of the stub shaft below the nut, and ultimately, off-center with the turbocharger axis, thus contributing to even greater core unbalance.

At the point of manufacturing, all of these critically balanced items are assembled and the core balanced, that is, the balance of the rotating assembly, assembled to the bearing housing, supported by the journal bearings, is spun at high speed with oil pressure supplied to support the rotating shaft on its designed oil film. This procedure checks the balance of the rotating "core". If the balance is within limits, then the core is satisfactory and is released for assembly into a complete turbocharger. If the balance is out of limit, then the core undergoes a procedure to bring the balance into limits before it is assembled into the housings to produce a turbocharger.

Accordingly, when the turbocharger leaves the factory, the rotating core is within a balance limit, and the turbocharger could be expected to live for several engine rebuild periods.

In the period the turbocharger is operating on the engine, the balance of the rotating core can be degraded in many ways, some of which are listed here: the turbine wheel is subjected to damage from particles, sometimes quite large, from the combustion chamber and exhaust manifold, which causes damage ranging from bending to breaking off of parts of the blades, which then causes a deviation from the factory balance condition; the compressor wheel also can be subjected to damage inflicted by "foreign objects" which are ingested into the system. Loss of oil pressure for a period can cause loss of support of the rotating assembly, which can result in a wheel rub on either, or both wheels, which, at minimum, can cause the removal of some blade material (by rubbing on the housing), which then alters the mass of several adjacent blades, or in a heavier rub can bend the blades. Both of these resultants will cause a change in the balance of the rotating assembly.

If the rotating assembly does develop an unbalance condition less than those discussed above, a resultant of the core unbalance can be the generation of acoustic abnormalities at a once per revolution frequency. With a turbocharger rotating at 150,000 RPM to 300,000 RPM, an unbalance-related acoustical event will be in the frequency range of 2,500 to 5,000 Hertz, which makes the frequency somewhere around the highest frequency producible by a flute (2093 Hz) and the highest producible by a piano, (4186 Hz). So the customers do complain about the audible noise.

A measure of the efficacy of a turbocharger bearing system is the ability of the bearing system to control and support the rotating assembly under all conditions. Turbocharger bearing systems come in many designs from ball bearings for very large and some high performance turbochargers, to different configurations of fixed sleeve bearings, floating oil film bearings, air bearings. They all have one thing in common, and that is the need for fine balance control of the rotating assembly.

The level of balance for the individual components is generated, to some extent, by the level of balance acceptable by the bearing system in the rotating assembly. An automotive type, oil pressure fed, well designed bearing system will present to a manufacturer a maximum unbalance which the bearing system can control and will provide sufficient damping that it remains in control of the shaft excursions under all conditions. This means that any balance condition lower than the maximum unbalance condition acceptable for that bearing system, on a specific engine, is acceptable from an engineering point of view. The cost to achieve this level of core unbalance increases as the level of acceptable unbalance decreases. In the experience of the inventor, some turbocharger cores pass through the core balance "gate" with no additional attention. Some cores need attention, which can be as little as undoing the compressor nut, rotating some components, re-applying the clamp load and then re-testing, to replacing components in the rotating core.

The goal of a turbocharger manufacturer is to offer product at the lowest cost with the highest possible reliability and durability. Balance is a key factor in the durability and reliability drivers. So it can be seen that there is a general need to present cores to the core test device which fall well inside the unbalance lower limit to both decrease assembly costs and increase turbocharger life.

SUMMARY OF THE INVENTION

The above objects were accomplished, and the present invention achieved, by the development of a self-centering geometry between the top of the compressor wheel and the lower face of the compressor nut to align these two components to the turbocharger axis and thus reduce the potential unbalance of the rotating core.

BRIEF DESCRIPTION OF THE DRAWINGS

The present invention is illustrated by way of example and not limitation in the accompanying drawings in which like reference numbers indicate similar parts and in which.

DETAILED DESCRIPTION OF THE INVENTION

Turbocharger assemblies are core balanced to ensure required life and to control rotational vibration induced noise. The inventor realized that a high percentage of turbocharger cores were not passing the core balance checking station which means that the turbochargers had to be re-processed, some several times, to achieve a "pass" under the core balance limit. The mean number of passes through the core balancing operation was 3, with a maximum allowable of 5, before the core was rejected for major rework. This resulted in major manufacturing and capital costs to the manufacturer.

Compressor wheel machining must be an intricate and extremely accurate task (see above) in order for the compressor wheel center of gravity to lie on the turbocharger axis when the wheel is included in the turbocharger assembly.

Figure 7:
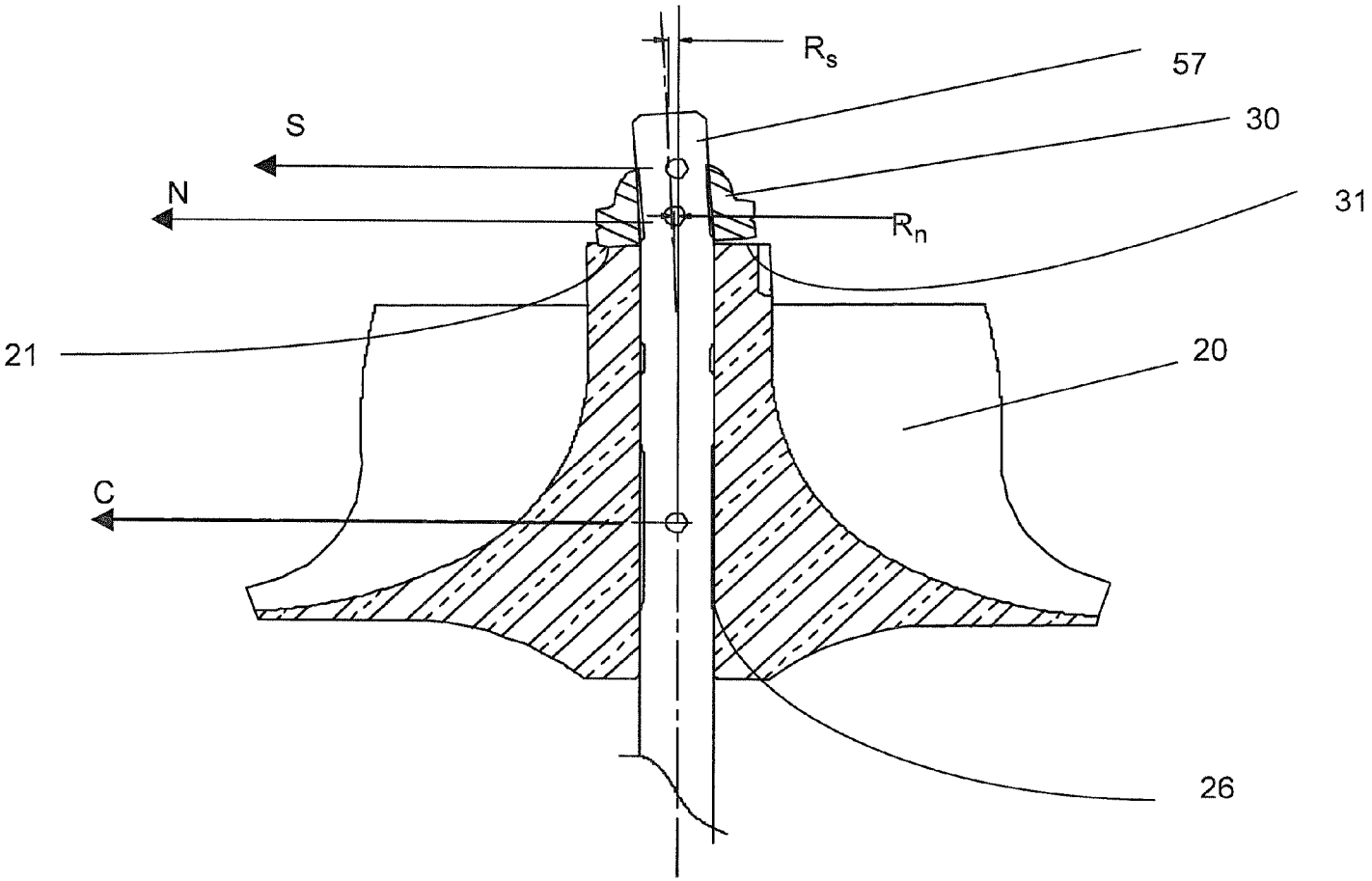
Fig. 7 Prior Art
FIG. 7 depicts the assembly of FIG. 6 subjected to runout of the nut.

As shown in FIG. 7, as clamp load is applied to the compressor wheel, by rotating the nut to travel down the helix angle of the thread, several events can happen. The act of rotating the nut against the face (21) on the nose of the compressor wheel can cause the nut to dig into the face and track off-center. This tracking causes the mass center of the nut to move off the turbocharger axis which results in an unbalance (N), equal to the mass of the nut times the displacement ($R_n$) perpendicular to the turbocharger axis.

This displacement also causes a bending of the stub shaft which results in yet another unbalance force (S), which is equal to the mass of the stub-shaft (57) deviated from the turbocharger axis (35) times the displacement ($R_s$). The bending of the stub-shaft can also cause a displacement of the compressor wheel center-of-gravity, which is indicated in FIG. 7 as an unbalance force of "C". Resisting these bending events, is the interaction of the outside diametral surface of the stub-shaft (61), which is a sliding fit with the inside diametral surface (26) of the hole (27) in the compressor wheel (20), aided by the compression of the clamp load applied by the interaction of the internal threads (32) in the compressor nut (30) against the threaded end (57) of the stub-shaft (56), forcing the lower mounting face (22) of the compressor wheel against the stub shaft face.

Figure 1:
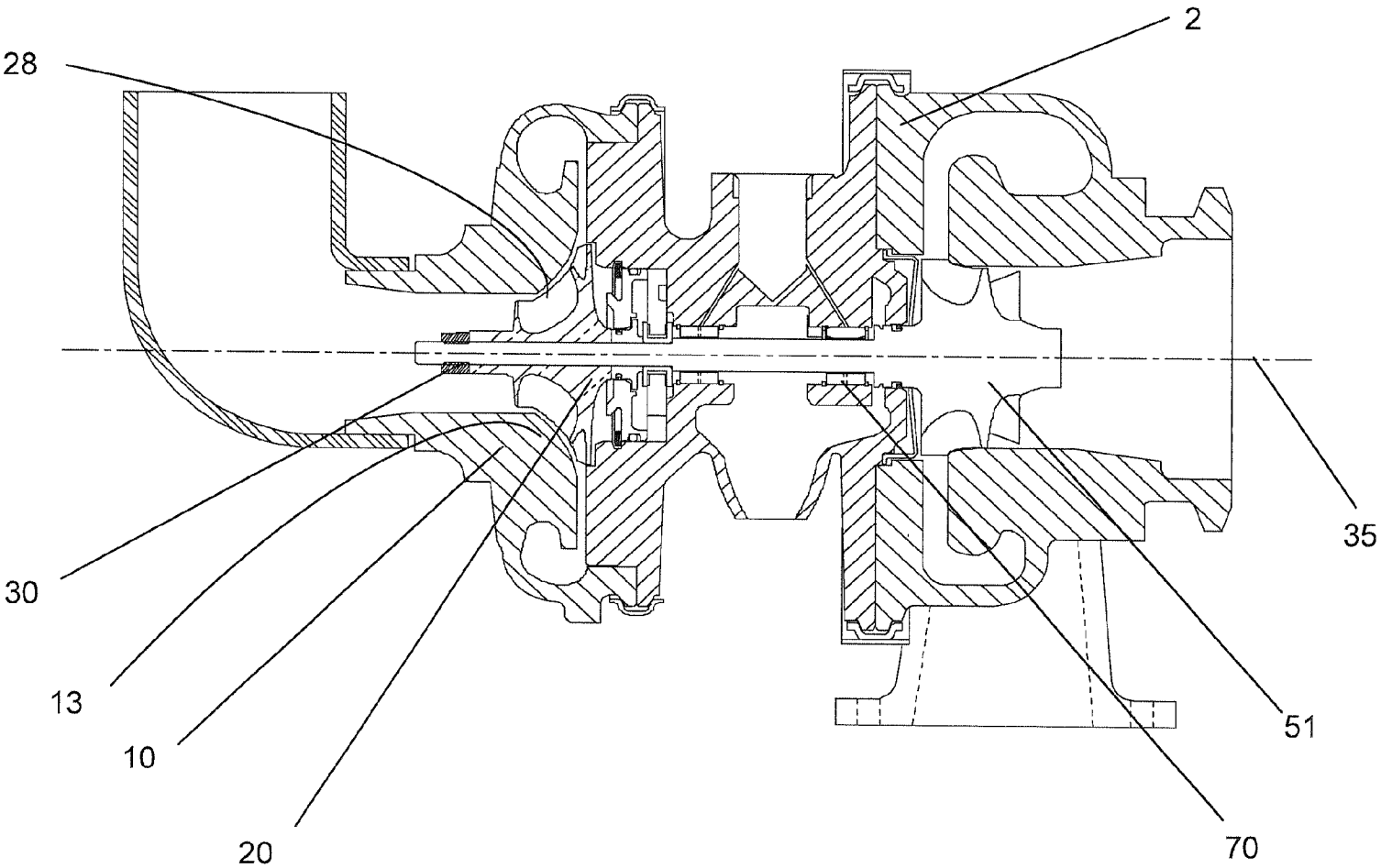
Fig. 1 Prior Art
FIG. 1 depicts a section of a turbocharger assembly.
Figure 2:
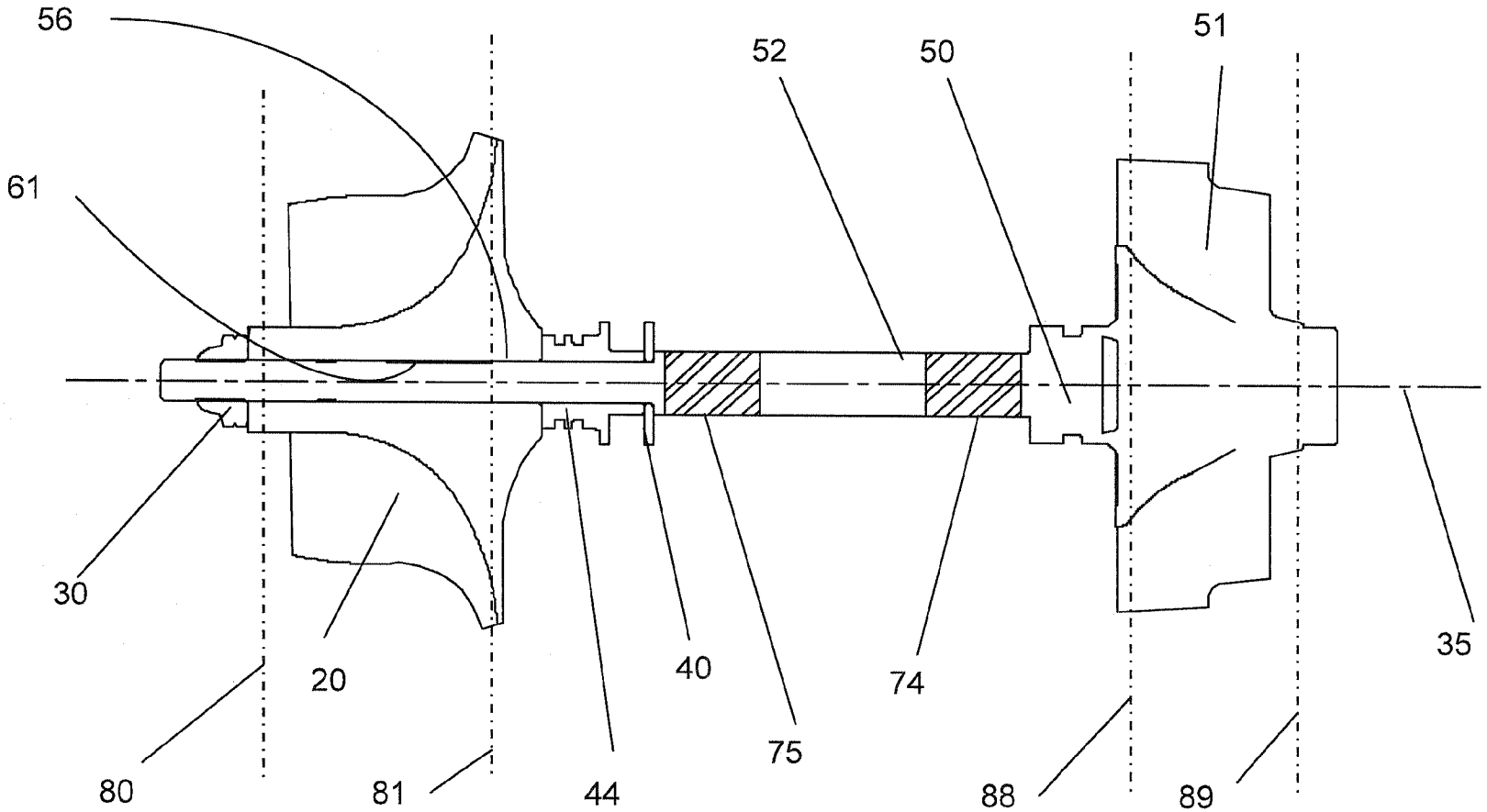
Fig. 2 Prior Art
FIG. 2 depicts the rotating components in a turbocharger.
Figure 3:
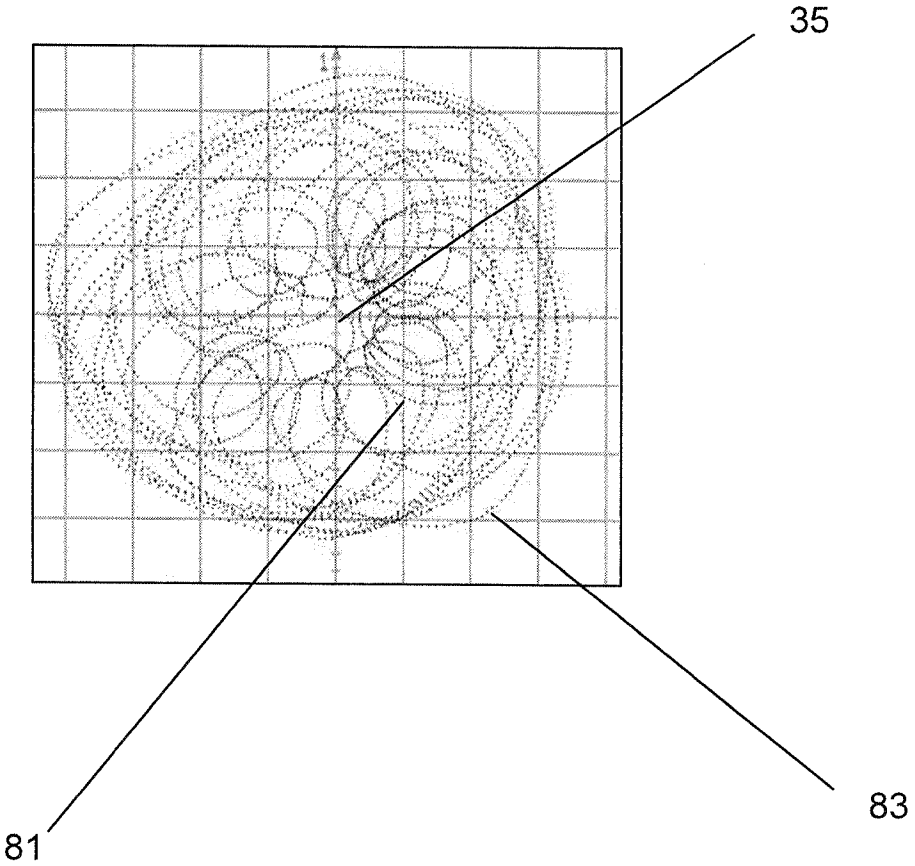
Fig. 3 Prior Art
FIG. 3 depicts the orbits made in testing.
Figure 4:
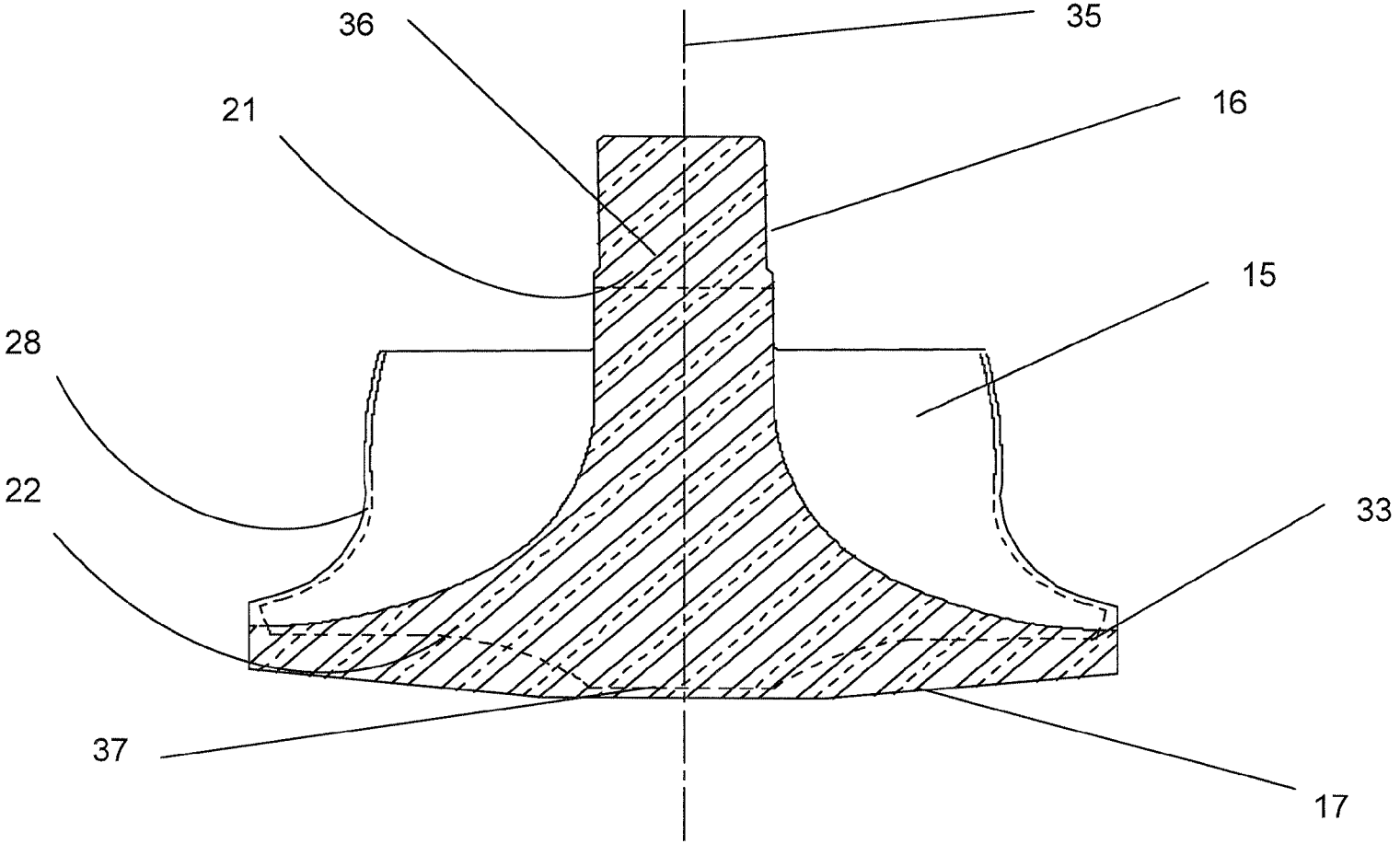
FIG. 4 depicts a compressor wheel casting.
Figure 5:
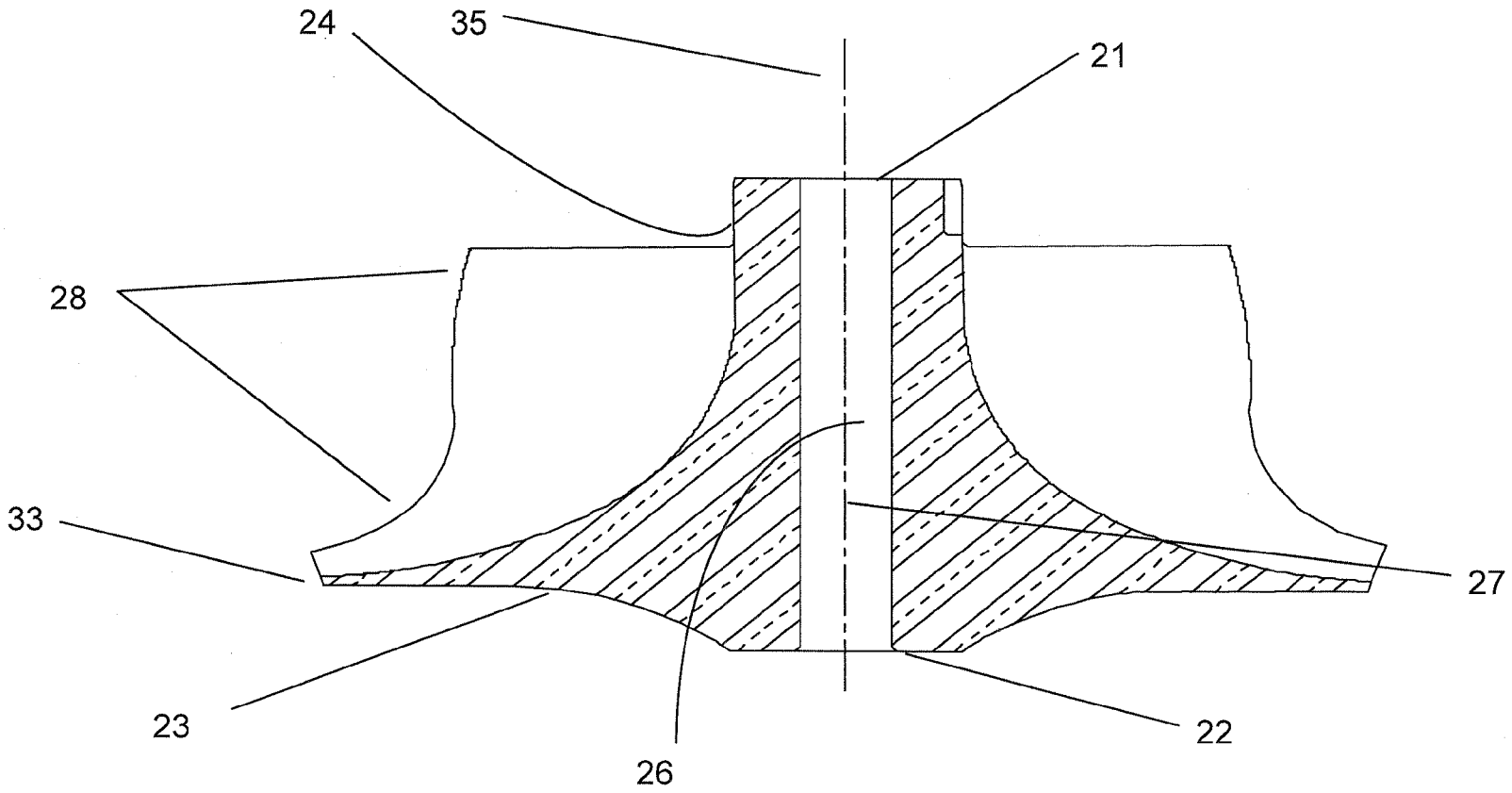
Fig. 5 Prior Art
FIG. 5 depicts a machined compressor wheel.
Figure 6:
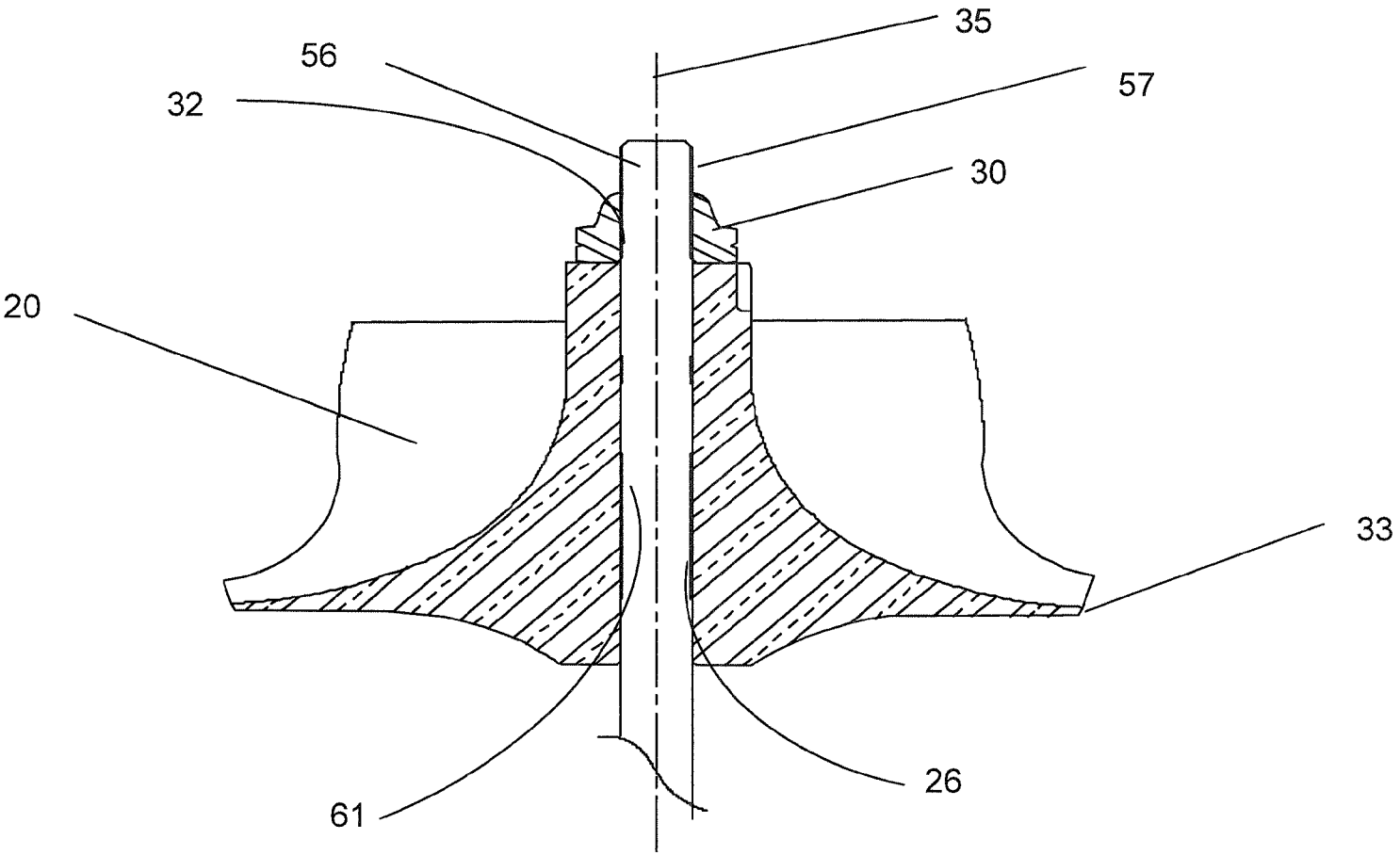
Fig. 6 Prior Art
FIG. 6 depicts the compressor wheel mounted on a shaft, with a nut.
Figure 8B:
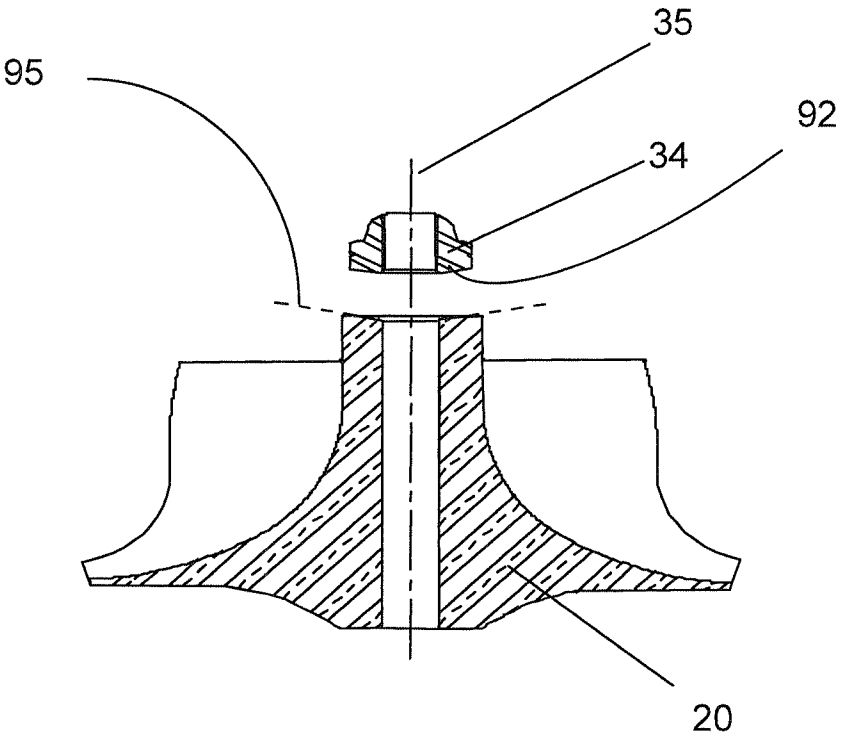
FIGS. 8A and B depict the first embodiment of the invention.
Figure 8A:
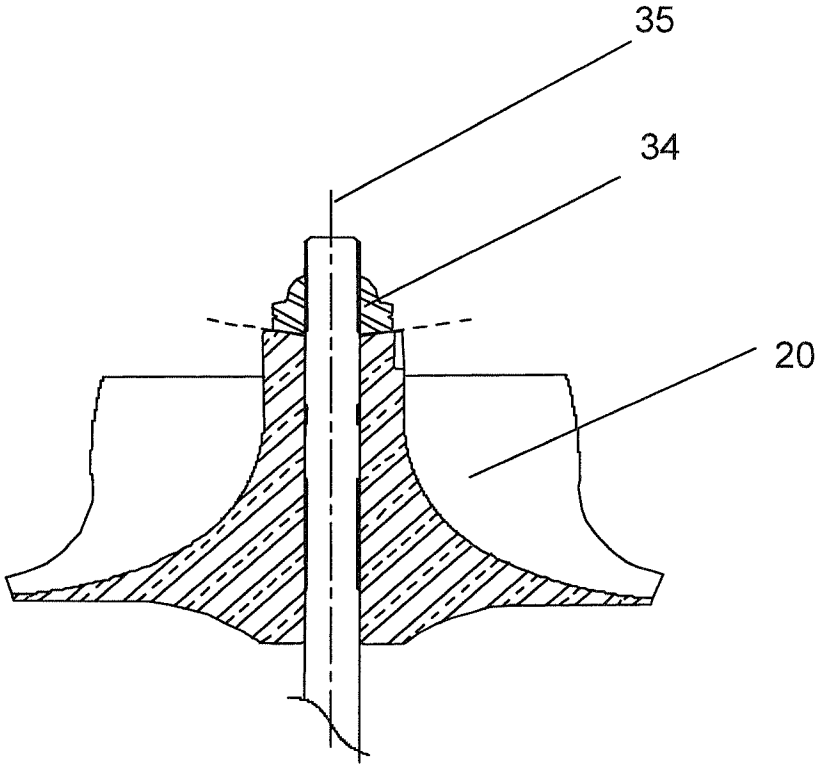

Contrary to the normal and widespread design and manufacturing protocol for machining a compressor wheel with the top surface (21) of the nose of the compressor wheel machined flat, whereby to make flush contact with a flat-bottomed nut (30), as shown in FIG. 6, the inventor, as seen in FIGS. 8A and 8B, added self centering complementary mating contact surfaces to the compressor nut and compressor wheel, for example, an exterior frusto-conical surface (92) to the compressor nut (34) and an interior frusto-conical surface (95) to the top of the nose of the compressor wheel (20). The surfaces are referred to as "frusta" conical since the peak of the shape would be in the area occupied by the compressor wheel bore, thus, would be "cut off". This frusto-conical interface prevents the nut from rocking and tracking on the nose of the compressor wheel while centering the top of the compressor wheel and the compressor nut on the shaft. With this exterior frusto-conical interface in place, the nut forces the interior frusto-conical surface in the top of the nose of the compressor wheel to center itself under the nut, and thus the clamping forces are resolved such that they center on the shaft and wheel centerline. This reduces the opportunity for there to be a major out-of-balance force due to any offset of the centers of gravity of the stub shaft, nut, and compressor wheel. As a result, the major unbalance force on the compressor end is confined to only the imbalance of the compressor wheel component itself.

For the purpose of defining the self-centering mating surfaces of the nut and wheel, all that is necessary is that one surface includes an annular region of narrowing concavity, the complementary surface includes a region of widening convexity, which cooperate such that when the two surfaces are brought together, the narrowing concavity and the complementary widening convexity cause the compressor wheel to center under the nut. The surfaces may be, e.g., frusto-conical, frusto-spherical, part conical and part spherical, even mixtures of flat and conical or flat and spherical ("stepped"), or combinations of differently angled conical surfaces or combinations of different curvature surfaces used in the interface of nut and compressor wheel, it is assumed that the conical surfaces can be any angle, and the curve be any curvature, so long as the mating surfaces exhibit concentricity with the shaft axis and cooperate to center the compressor wheel at the shaft axis. The interface shape may even assume the shape of a surface of revolution of a Bezier curve, or the shape of revolution of a path of Bezier curves, so long as the contacting surfaces cooperate to center the nose end of the compressor wheel. The cooperating surfaces could even be provided with one or more concentric, reverse image "ripples". However, since all designs have a similar degree of effectiveness, manufacturing cost would dictate a preference for simpler, easily manufactured engaging surfaces.

Figure 10B:
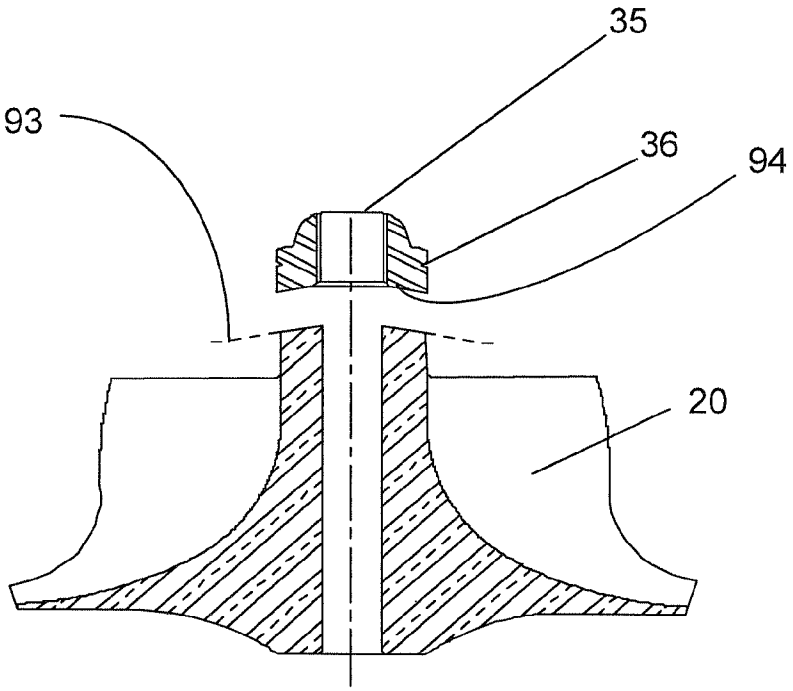
FIGS. 10A and B depict the first variation of the first embodiment of the invention.
Figure 10A:
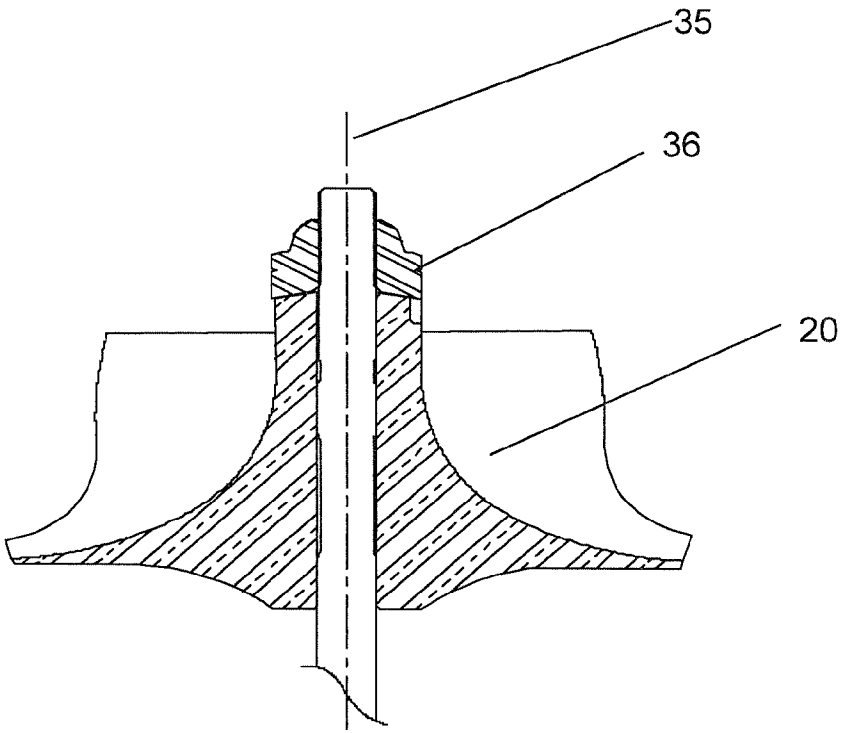

In the first variation of the first embodiment of the invention, as seen in FIGS. 10A and 10B, the exterior and interior frusto-conical elements are reversed as compared to FIGS. 8A and 8B. The interior frusto-conical surface (94) is fabricated onto the nut (36), and the exterior frusto-conical surface (93) is fabricated into the compressor wheel (20). While geometrically this juxtaposition causes no difference in the assembly of nut and wheel to the shaft, structurally it causes a shift to greater compressive stress on the nose of the compressor wheel.

Figure 9B:
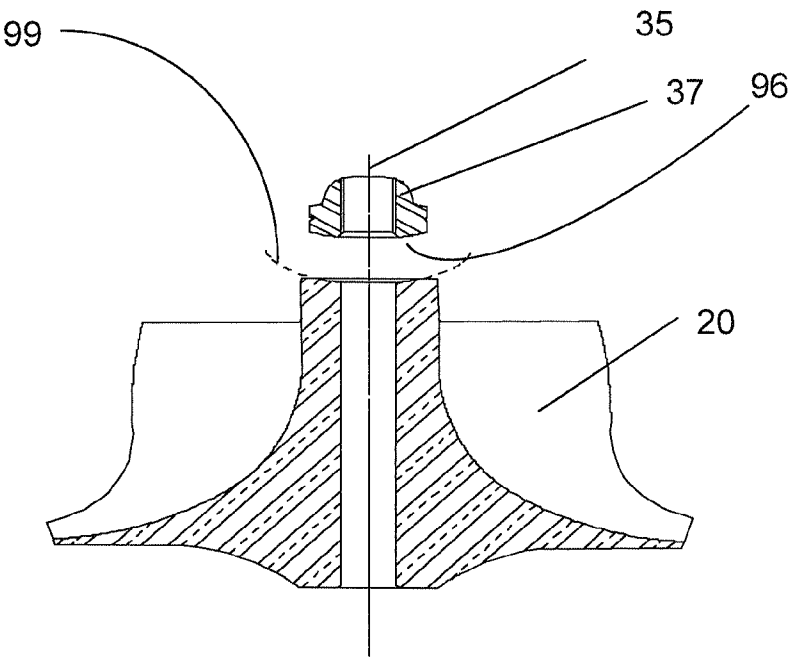
FIGS. 9A and B depict the second embodiment of the invention.
Figure 9A:
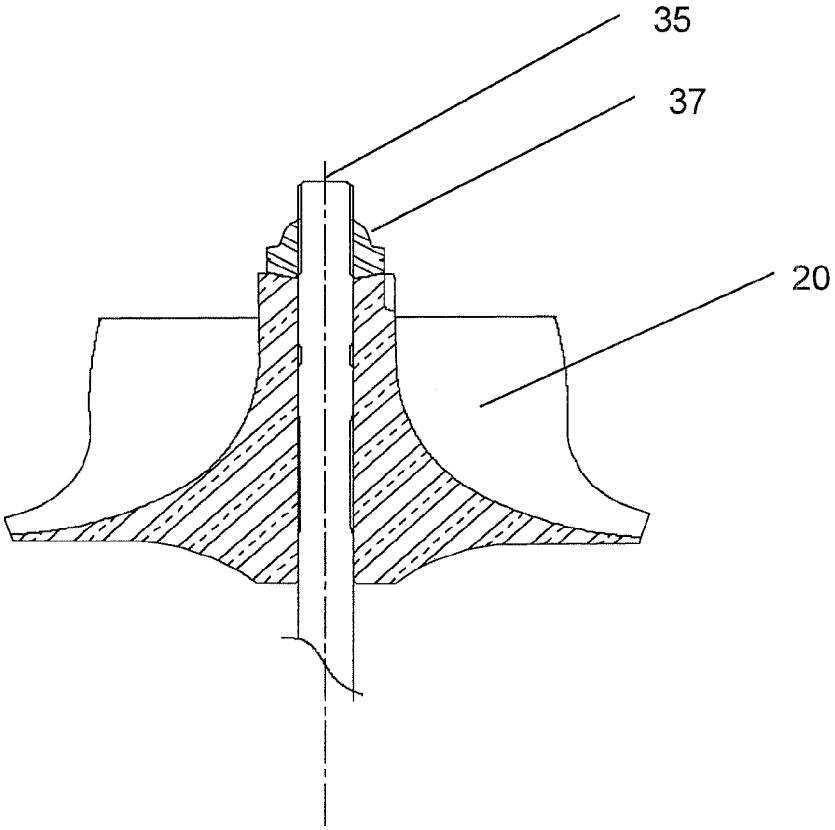

In the second embodiment of the invention, as seen in FIGS. 9A and 9B, the inventor added an exterior frusto-spherical surface (96) to the compressor nut (37) and an interior frusto-spherical surface (99) to the top of the nose of the compressor wheel (20). This frusto-spherical interface prevents the nut from rocking and tracking on the nose of the compressor wheel while centering the top of the compressor wheel and the compressor nut on the shaft. With this exterior frusto-spherical interface in place, the nut will center itself on the interior frusto-spherical surface in the top of the nose of the compressor wheel. Thus the clamping forces are resolved such that they center on the shaft and wheel centerline. This reduces the opportunity for there to be a major out-of-balance force due to any offset of the centers of gravity of the stub shaft, nut and compressor wheel. As a result, the major unbalance force on the compressor end is confined to only the imbalance of the compressor wheel component itself.

Figure 11B:
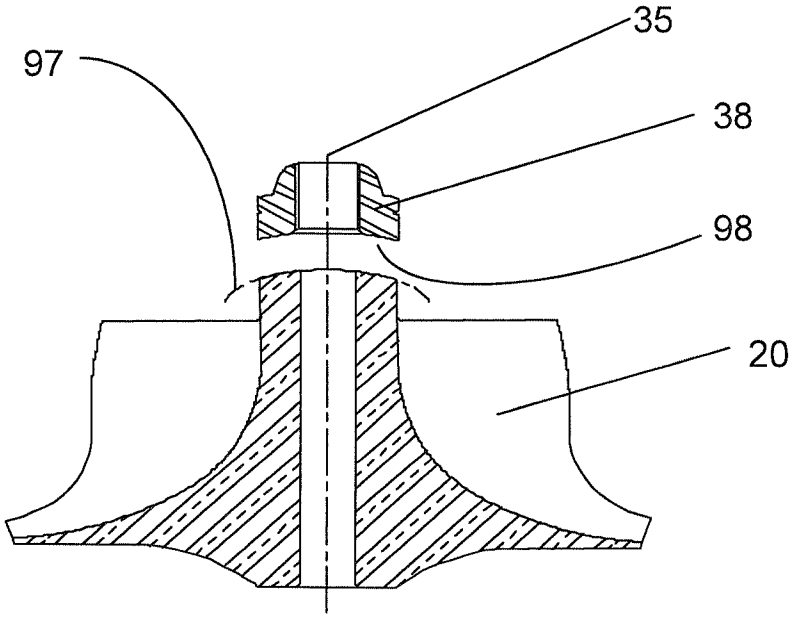
FIGS. 11A and B depict the first variation of the second embodiment of the invention.
Figure 11A:
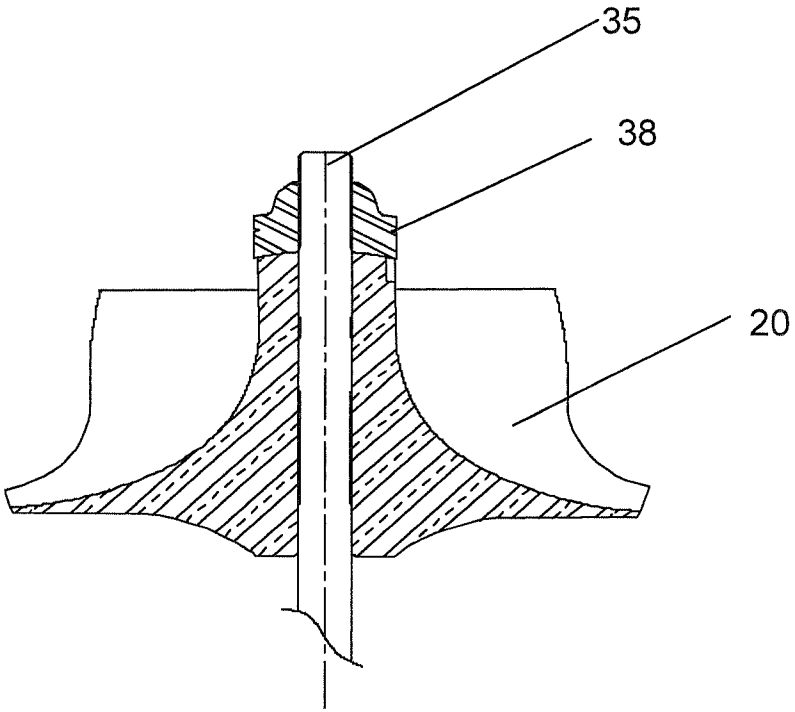

In the first variation of the second embodiment of the invention, as seen in FIGS. 11A and 11B, the exterior and interior frusto-conical elements are reversed. The interior frusto-spherical surface (98) is fabricated onto the nut (39), and the exterior frusto-spherical surface (97) is fabricated into the compressor wheel. While geometrically this juxtaposition causes no difference to the assembly of nut and wheel to the shaft, structurally it causes a shift to greater compressive stress on the nose of the compressor wheel.

Figure 12B:
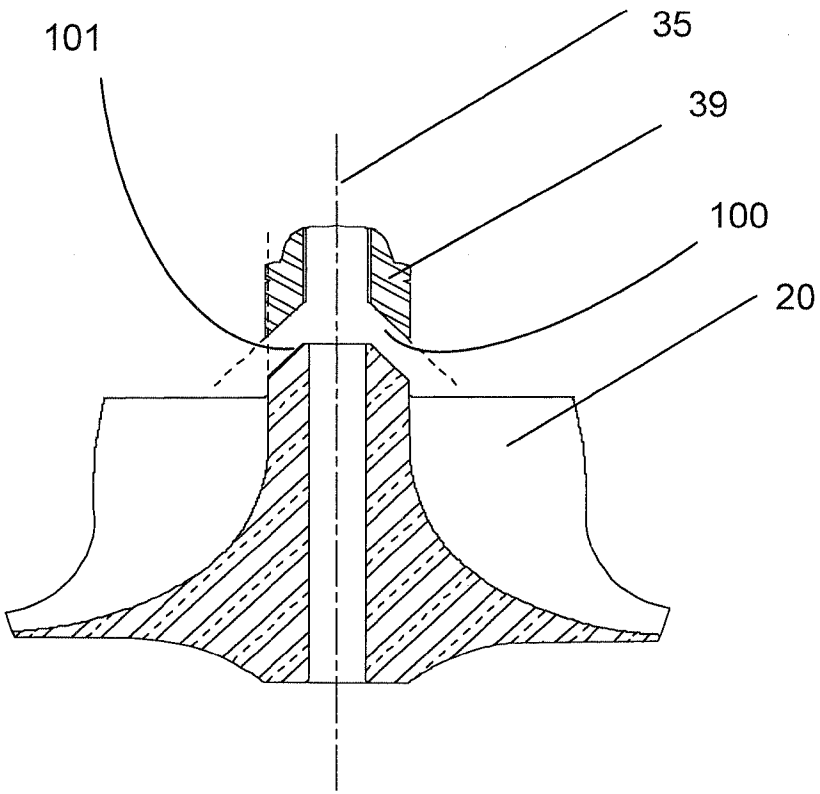
FIGS. 12A and B depict the third embodiment of the invention.
Figure 12A:
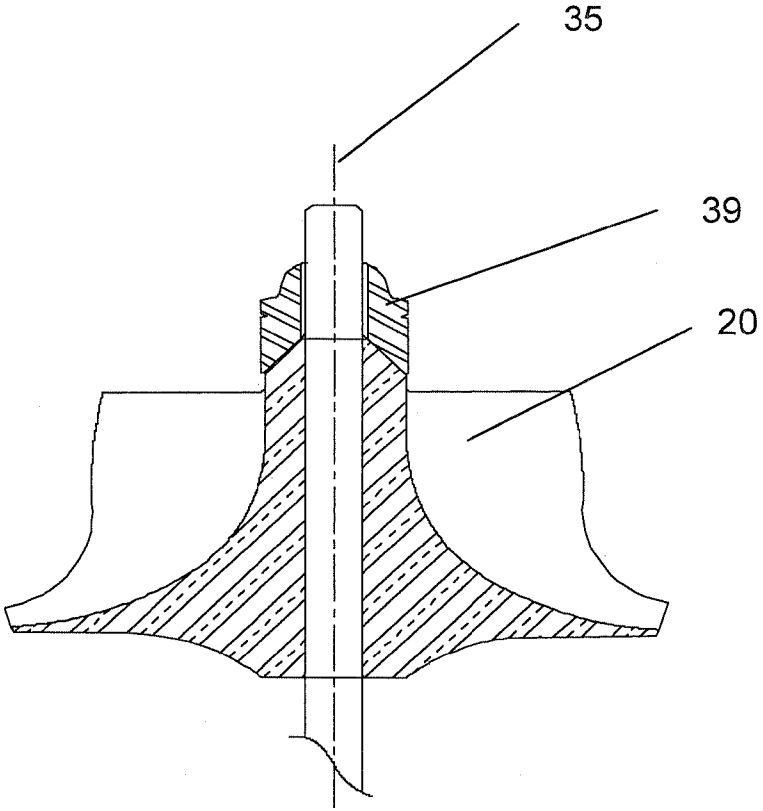

In the third embodiment of the invention, as seen in FIGS. 12A and 12B, the intersection of the top surface of the wheel and the sides of the nose of the wheel is used as the centering medium. In the exemplary third embodiment of the invention, a large chamfer (101), radius, or spherical surface is machined into the top face, and the side face of the nose of the compressor wheel. The compressor nut (39) has fabricated into its surface a mating frusto-conical (100) or frusto-spherical surface. As clamp load is applied to the compressor nut, by rotating the compressor nut down the thread (57), the nut centers on the compressor wheel (20) and the nut and compressor wheel center to the stub shaft (56). This centering at assembly forces the mass centers of the stub shaft, nut, and compressor wheel to become aligned with the turbocharger axis (35). This centering thus reduces the opportunity for there to be a major out-of-balance force due to any offset of the centers of gravity of the stub shaft, nut, and compressor wheel. As a result, the major unbalance force on the compressor end is confined to only the imbalance of the compressor wheel component itself.

Now that the invention has been described,

We claim:

1. A method for balancing a rotating assembly, the rotating assembly comprising a shaft (52) with a turbine end and a threaded compressor end (56), a turbine wheel (51) rigidly connected to the turbine end of the shaft, a compressor nut (30, 34, 36, 37, 38, 39), and a compressor wheel (20) with a nose end face (21) and a hub end face (22), and held in position on the compressor end of the shaft by the clamp load from the compressor nut (30, 34, 36, 37, 38, 39) threaded onto said threaded end of the shaft, wherein said rotating assembly rotates about a centerline, and wherein the nut (30, 34, 36, 37, 38, 39) and the compressor wheel nose end face are provided with complementary engaging surfaces such that tightening of the nut against the compressor wheel causes said compressor wheel to center relative to the centerline of the rotating assembly, the method comprising:

(a) introducing the compressor wheel (20) onto the shaft, (b) threading the nut onto the threaded end of the shaft and tightening the nut (30, 34, 36, 37, 38, 39) against the compressor wheel (20) causing the compressor wheel to align on a centerline generated by the cylindricity of the zones (74 and 75) of the shaft and wheel acted upon by the journal bearings, and (c) measuring the imbalance of the rotating assembly, and if the imbalance is greater than a predetermined value, subjecting, said rotating assembly to a balancing step, and repeating step (c1) until the rotating assembly imbalance is below the predetermined threshold.

2. The method as in claim 1, further comprising, after step (b):

(c2) measuring run-out of the nose of the compressor wheel as a component of the rotating assembly, relative to the cylinder defined by journal bearing diameters, and if the run-out is greater than a predetermined value, subjecting said rotating assembly to a balancing step, and repeating step (c2) until the run-out is below the predetermined threshold.

3. The method as in claim 2, wherein said run-out is measured using a shaft motion nut having a cylinder ground onto it's outer surface coaxial to the centerline of the assembly of nut and shaft.

4. The method as in claim 3, wherein said shaft motion nut and the compressor wheel nose end face are provided with complementary frustro-conical or frustro-spherical engaging surfaces.

* * * * *